US008464641B2

(12) United States Patent
O

(10) Patent No.: US 8,464,641 B2
(45) Date of Patent: Jun. 18, 2013

(54) FORTY MILLIMETER CALIBER EXERCISE BULLET

(75) Inventor: Se-Hong O, Daejeon (KR)

(73) Assignee: Korea C.N.O. Tech Co. Ltd., Uigok-Ri, Yeongsun-Myeon, Mungyeong-Si, Gyeongsangbuk-Do (KR)

( * ) Notice: Subject to any disclaimer, the term of this patent is extended or adjusted under 35 U.S.C. 154(b) by 28 days.

(21) Appl. No.: 13/067,271

(22) Filed: May 20, 2011

(65) Prior Publication Data

US 2012/0180685 A1 Jul. 19, 2012

(30) Foreign Application Priority Data

May 26, 2010 (KR) ..... 10-2010-0049353

(51) Int. Cl.
*F42B 12/48* (2006.01)

(52) U.S. Cl.
USPC ..... 102/334; 102/370; 102/239; 102/242; 102/245; 102/256; 102/444; 102/498; 102/529

(58) Field of Classification Search
USPC ..... 102/334, 367, 368, 369, 370, 237, 102/239, 242, 244, 245, 256, 444, 445, 446, 102/447, 498, 499, 529
See application file for complete search history.

(56) References Cited

U.S. PATENT DOCUMENTS

| | | | | | |
|---|---|---|---|---|---|
| 1,145,937 | A * | 7/1915 | Stout et al. | ..... | 102/242 |
| 1,166,942 | A * | 1/1916 | Semple | ..... | 102/242 |
| 1,224,631 | A * | 5/1917 | Girdwood | ..... | 102/242 |
| 1,515,668 | A * | 11/1924 | Fischer | ..... | 102/234 |
| 3,703,866 | A * | 11/1972 | Semenza | ..... | 102/238 |
| 4,860,657 | A * | 8/1989 | Steinicke et al. | ..... | 102/334 |
| 5,454,324 | A * | 10/1995 | Larmignat et al. | ..... | 102/334 |
| 5,499,582 | A * | 3/1996 | Schiessl et al. | ..... | 102/334 |
| 6,889,611 | B2 * | 5/2005 | Scherer et al. | ..... | 102/334 |
| 7,124,690 | B1 * | 10/2006 | Tadros et al. | ..... | 102/370 |
| 7,614,458 | B2 * | 11/2009 | Gross | ..... | 169/43 |
| 2003/0056680 | A1 * | 3/2003 | Santacreu | ..... | 102/334 |

* cited by examiner

*Primary Examiner* — James Bergin
(74) *Attorney, Agent, or Firm* — GWiPS

(57) ABSTRACT

A forty millimeter caliber exercise bullet has been improved for properly exploding on a target, and securely maintaining the unloaded status during ordinary time. The improved exercise bullet is comprised of: a skirt (200), a striking pin (10), a safety device assembly (300) consisting of a detent cover (310) with a central mounting groove (311) and a pair of mounting grooves (312), a detent (320) for retaining the striking pin (10) by engaging or disengaging into the circumferential groove (11) by springs (323), a detonator cap (330) forming a hollow pocket (331) to insert a detonator trigger (20), a washer (30), a press-spring (332) for pressing a guiding cap (340), an explosion pipe (400), a smoke shell (500), and an ogive (600). When the bullet is fired, the rotation of the bullet generates centrifugal force to slide the retainer outward for disengaging the circumferential groove. Then, the striking pin moves upward to impact the detonator trigger when it hit on the target.

3 Claims, 5 Drawing Sheets

FORTY MILLIMETER CALIBER EXERCISE BULLET

BACKGROUND OF THE INVENTION

1. Field of the Invention

The present invention relates to an exercise bullet for training a grenade launcher. More particularly, a forty millimeter caliber exercise bullet has been improved to be more reliable and safer, while it is being handled in the loading or unloading status. As soon as a projectile is launched, an explosion will properly take place at a target for training the grenade launcher through the exercise.

2. Related Prior Art

A conventional forty millimeter caliber exercise bullet has a configuration in which a firing pin of the grenade launcher strikes a detonator of a bullet; a propellant in the bullet shell is primarily ignited for launching a projectile. The firing pin will strike a detonator trigger to ignite the smokescreen generating agent when the projectile hits the target ground. Due to the rapid combustion of the propellant, the pressure in the shell is suddenly exploded to expel the projectile. When the shell is impacted on the target ground, a smokescreen is generated. Thereby, the trainer will be able to easily recognize when the bullet hits the target ground during the exercise.

However, the conventional exercise bullet has many accidental explosion problems due to the malfunction of the detonator trigger and/or the firing pin to control the ignition or launching of the projectile. Because the detonator trigger or the firing pin is improperly operated, the smokescreen generating agent fails to ignite at the target ground. Thus, it causes trouble for the training exercise. Specifically, a head part of the projectile, i.e., an ogive (wind shell) is impacted; the smokescreen generating agent fails to ignite, because the transmitted impact force lacks the strength to ignite the fuse. Because the firing pin operates improperly, the impact force fails to activate the detonator trigger. Thus, the detonator trigger fails to ignite the smokescreen generating agent for launching the projectile. Thus, the conventional exercise bullets have frequently incurred trouble; it causes to be interrupted the training of the grenade launcher.

Therefore, research is required for developing more reliable devices for safer training of the grenade launcher. A reliable exercise bullet will not ignite when it is accidently dropped on the ground, or an unexpected explosion will not occur due to mishandling in an embarrassing situation.

SUMMARY OF THE INVENTION

Therefore, the present invention has been developed in view of the above problems. The object of the present invention is to provide an improved forty millimeter caliber exercise bullet, which is more reliable and safer, when it is handled in the loading status for training or unloading status for storage. When a projectile is launched for an exercise of the grenade launcher, the bullet in the loading status must be properly activated to explode at the target place.

According to the present invention, the object is to provide the improved forty millimeter caliber exercise bullet, which is comprised of: a cartridge assembly (100) forming a cylindrical shape with a hollow inside for containing a percussion primer (110) and primer housing (120) at the central lower portion; a skirt (200) forming a cylindrical shape with thread on the inner surface of the lower central portion; an outer surface having a rounded bottom for fixedly inserting into the cartridge assembly (100); a striking pin (10) forming a circumferential groove (11) on the outer surface of the lower portion; a safety device assembly (300) consisting of a detent cover (310) having a disk shape with a central mounting groove (311) for seating the striking pin (10) and a pair of mounting grooves (312) connected to the mounting seat (311) in the radial directions; a detent (320) to retain the striking pin (10) for engaging or disengaging to the circumferential groove (11) by exerting the springs (323); the detent (320) having a retainer (321) at one side and a mounting stub (322) at other side; a detonator cap (330) forming a hollow pocket (331) at its central upper portion to insert a detonator trigger (20); a washer (30) sequentially installed from the top to insert a press-spring (332) for pressing a guiding cap (340) and encompassing the striking pin (10); the detonator cap (330) is bolted to the detent cover (310), so that the retainer (321) slides outward by centrifugal force to disengage the circumferential groove (11); the striking pin (10) moves upward to impact the detonator trigger (20); an explosion pipe (400) filled with an explosive agent; the lower central portion of the skirt (200) is threaded for fixedly connecting to the detonator cap (330) and the detent cover (310); a smoke shell (500) filled with a smokescreen generating agent and the lower portion of the smoke shell (500) is inserted between the upper inside of the skirt (200) and the outer side of the explosion pipe (400); an ogive (600) surrounding the smoke shell (500); and the lower portion of the ogive (600) fixedly inserting to the outer upper portion of the skirt (200).

The mounting grooves (312) are arranged to either the 180° angle, or the 120° angle in the radial directions.

The detent (320) forms the retainer (321) at one side and the mounting stub (322) at the other side for retaining the striking pin (10) by engaging or disengaging into the circumferential groove (11) of the striking pin (10). The retainer (321) has either one of rectangular or cylindrical shapes.

The detonator cap (330) forms the hollow pocket (331) for mounting the striker pin (10) and a through hole for passing a needle of the striking pin (10) when the retainer (321) moves outward by the centrifugal force to disengage the circumferential groove (11); then the striking pin (10) moves upward by the press-spring (332) to impact the detonator trigger (20).

DETAILED DESCRIPTION OF THE PREFERRED EMBODIMENTS

Hereinafter, an improved forty millimeter caliber exercise bullet of the present invention will be described in detail accompanying with the drawings.

Figure 1:
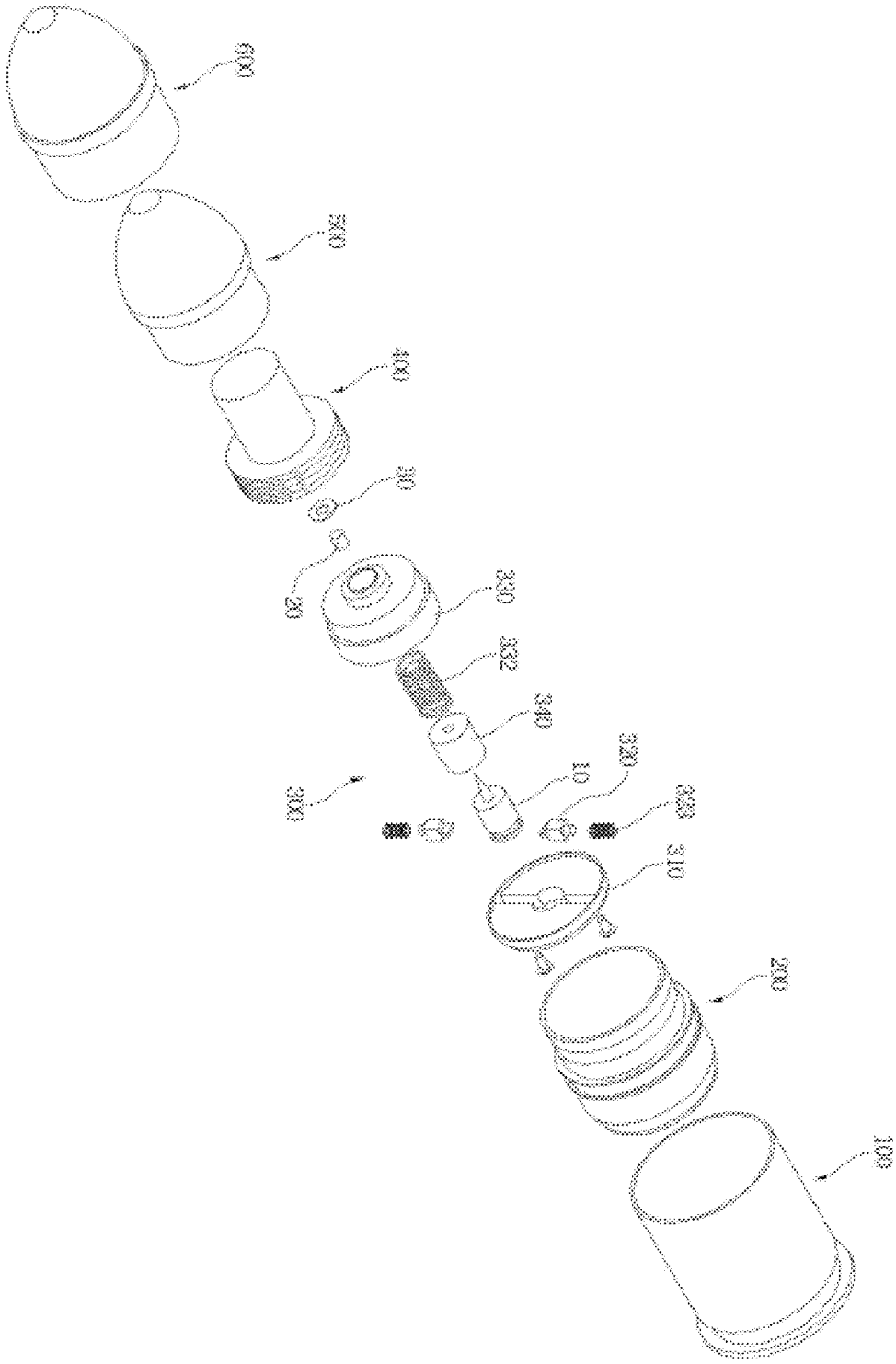
FIG. 1 is a perspective view showing an exploded forty millimeter caliber exercise bullet of the present invention.
Figure 2:
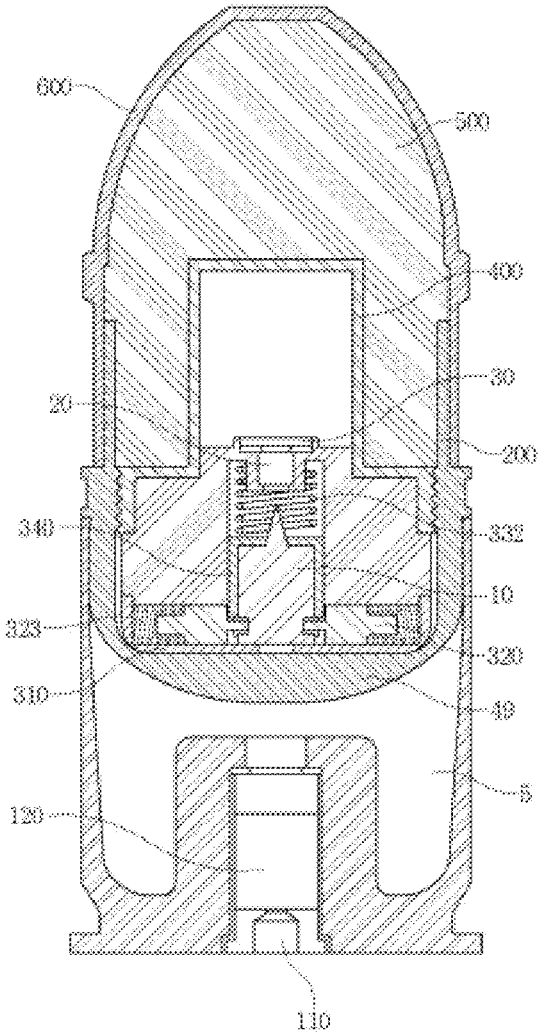
FIG. 2 is a cross-sectional view illustrating the forty millimeter caliber exercise bullet of the present invention.

FIG. 1 is a perspective view showing an exploded forty millimeter caliber exercise bullet of the present invention, and FIG. 2 is a cross-sectional view illustrating the forty millimeter caliber exercise bullet of the present invention.

The forty millimeter caliber exercise bullet of the present invention basically consists of: a cartridge assembly 100, which contains a percussion primer 110 and a primer housing 120; a skirt 200 being inserted into the cartridge assembly 100; a safety device assembly 300 for controlling a striking pin 10 to strike a detonator trigger 20; an explosion pipe 400 disposed in front of the safety device assembly 300; a smoke shell 500 surrounding the explosion pipe 400; and an ogive 600 surrounding the smoke shell 500.

In the cartridge assembly 100, a propellant in the primer housing 120 will be ignited for ejecting the exercise bullet from the grenade launcher due to the instant combusting pressure, when a firing pin of the grenade launcher strikes the percussion primer 110. For this purpose, the cartridge assembly 100 has formed a cylindrical-shape with a hollow inside containing the percussion primer 110 and the primer housing 120 in the center lower portion thereof.

The skirt 200 having a cylindrical-shape has formed a round bottom on the outer lower portion for inserting into the cartridge assembly 100, and threaded on central inner side of the skirt 200. Thus, the skirt 200 contains the safety device assembly 300 for connecting to the explosion pipe 400, the smoke shell 500 and the ogive 600. When the exercise bullet hits on the ground, the skirt 200 activates to protect the safety device assembly 300.

Figure 3:
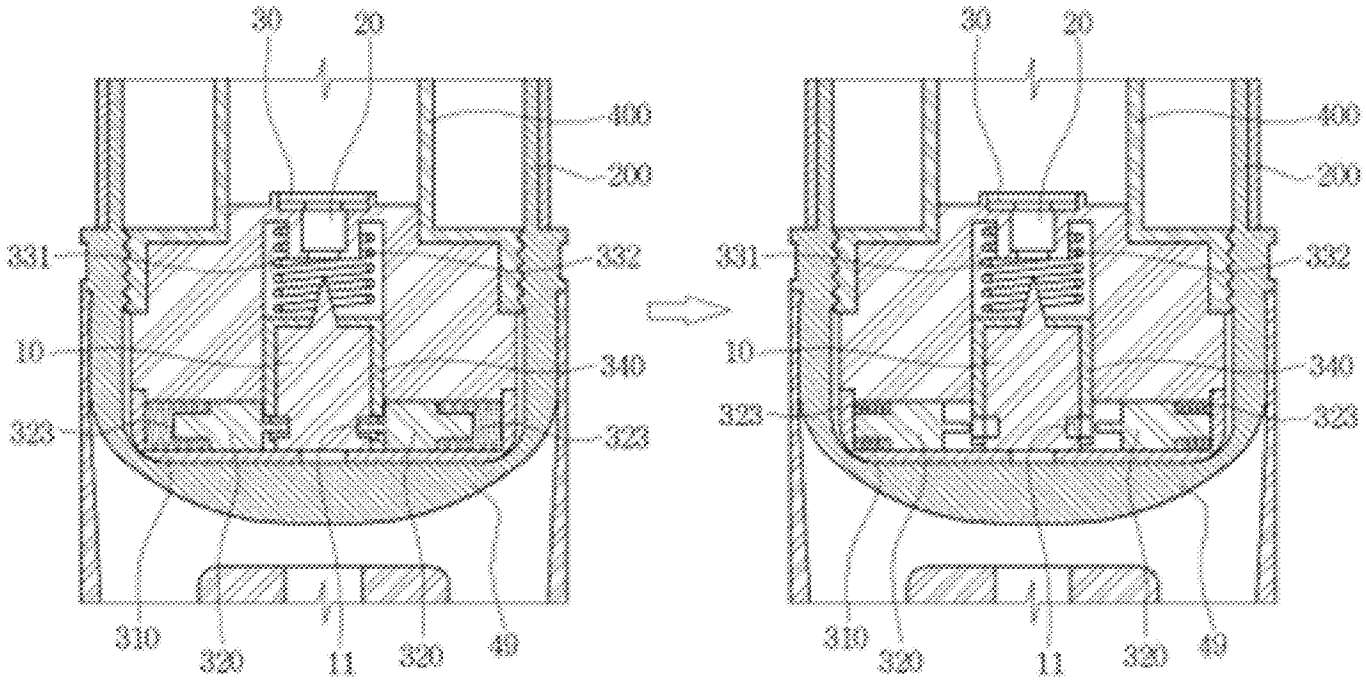
FIG. 3 is a cross-sectional view illustrating loaded and unloaded status of the forty millimeter caliber exercise bullet according to the safety device assembly of the present invention.

FIG. 3 is a cross-sectional view illustrating loaded and unloaded status of the forty millimeter caliber exercise bullet according to the safety device assembly of the present invention.

When the exercise bullet is fired, the shell will be rotated by means of the spiral grooves formed inside of the grenade launcher. Then, the exercise bullet in loaded status will activate the safety device assembly 300. The exercise bullets will be in unloaded status when it is stored or transported. For this purpose, the safety device assembly 200 consists of a detent cover 310 forming a disk shape and a central mounting groove 311 at the center, so that the bottom of the striking pin 10 with a circumferential groove 11 on its outside lower portion is seated into the central mounting groove 311. Further, a pair of mounting grooves 312 is connected in the radial direction to the central mounting groove 311. The detents 320 are disposed in the mounting grooves 312, so that the retainers 321 at one side of detents 320 are sliding to engage or disengage the circumferential groove 11 by exerting the springs 323, which are mounted on the mounting stubs 322 at the other side of the detent 320. A detonator cap 330 is forming a hollow pocket at the central portion thereof. The hollow pocket 331 is formed on the upper portion for sequentially inserting the detonating trigger 20, a washer 30 from the top. A press-spring 332 is inserted into the hollow pocket 331 for pressing a guiding cap 340, which encompasses the striking pin 10. Then, the detonator cap 330 has bolted to the detent cover 310.

The exercise bullet has provided the structure of the safety device assembly 300 as described above. The exercise bullet will not be exploded, as far as the retainers 321 of the detents 320 is engaged to the circumferential groove 11 of the striking pin 10 by exerting the spring 323 force. Even if the exercise bullet has impacted, for example, the ogive 600 is impacted, the striking pin 10 will not strike the detonator trigger 20, as far as the striking pin 10 is locked by the retainers 321. However, as soon as the exercise bullet is firing, the exercise bullet will generate the centrifugal force by rotation of the shell. For example, the rotation of approximately 3,600 RPM will be generated. Then, the detents 320 will be sliding outward. The retainers 321 are shifted outward to disengage the groove 11 of the striking pin 10, and the striking pin 10 impacts the detonator trigger 20 when the ogive 600 impacts the target ground. Then, the exercise bullet will be exploded.

Figure 4A:
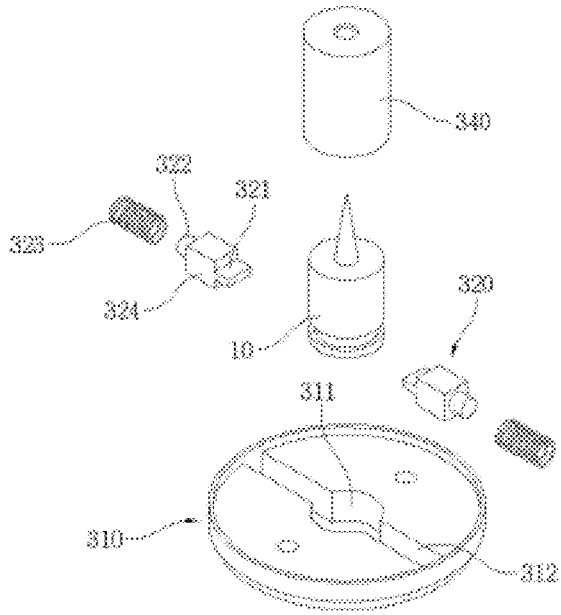
FIGS. 4A & 4B are illustrating the safety device assemblies of the forty millimeter caliber exercise bullets according to the embodiments of the present invention.
Figure 4B:
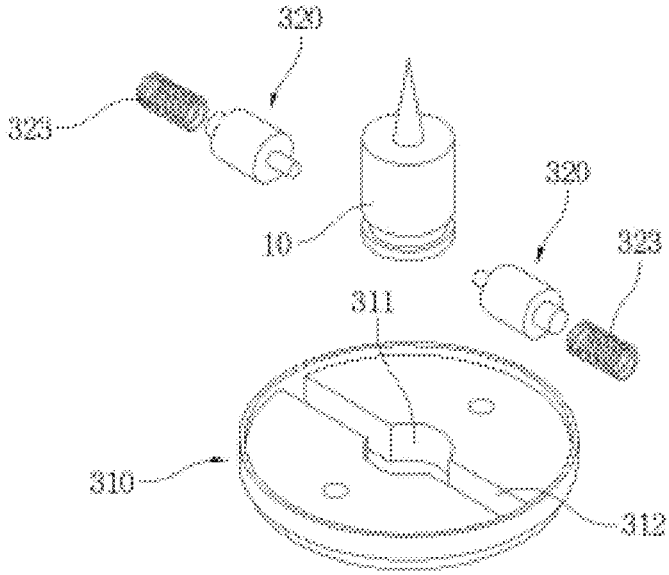
Figure 5:
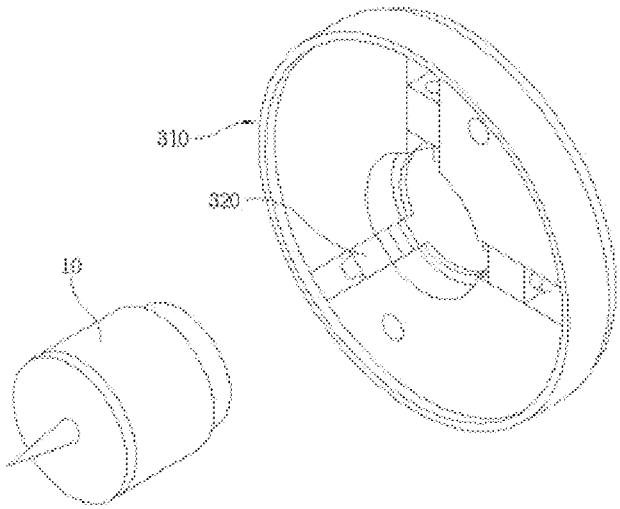
FIG. 5 is illustrating a safety device assembly of the forty millimeter caliber exercise bullet according to another embodiment of the present invention.

FIGS. 4A & 4B and FIG. 5 are illustrating the safety device assembly of the forty millimeter caliber exercise bullet of the present invention.

Herein, a pair of the mounting grooves 312 is aligned in radial directions, so that the detents 320 have arranged at a 180° angle in two directions for retaining the striking pin 10. Alternatively, it is possible to arrange the plural mounting grooves 312 to be a 120° angle in three directions. Thus, the striking pin 10 will be stably retained in three directions when the projectile is rotating for loading status. The striking pin 10 will be in a stationary situation for the unloading status.

Further, a detent block 324 is integrally formed with the retainer 321 and the mounting stub 322 of detent 320. The retainers 321 forming a rectangular shape are inserted in the mounting grooves 312 for sliding. Alternatively, the detent block 324 with the retainers 321 may form the cylindrical-shape to reduce a frictional resistance. The detents 320 are sliding in the mounting grooves 312 for engaging or disengaging into the circumferential groove 11 of the striking pin 10 to convert the safety device assembly 300 from unloaded status to loaded status. The detent 320 having a cylindrical shape is more reliable in activation as compared to the detent 320 having a rectangular shape.

In addition, a guiding cap 340 is further installed inside the detonator cap 330 after inserting a press-spring 332 from the bottom. The guiding cap 340 encompasses the striking pin 10 to have a through hole to pass a needle of the striking pin 10. The guiding cap 340 will move downward by the press-spring 332 to overlap the circumferential groove 11 of the striker pin 10 when the retainers 321 of the detents 320 are disengaged from the circumferential groove 11 of the striker pin 10. Therefore, the guiding cap 340 will prevent the retainer 321 reengaging into the circumferential groove 11, which causes the failure of the exercise bullet to explode. Due to the centrifugal force and impact force, the exercise bullet will be exploded when the bullet hits the target ground.

The explosion pipe 400 is filled with the explosive agent, which is made of an environmentally friendly degradable resin, such as poly-lactic acid (PLA). The lower portion of the explosion pipe 400 is thread-connected to the central portion of the skirt 200. The explosion pipe 400 is fixedly mounted in front of the detonator cap 330 and the detent cover 310 for inducing ignition of the explosive agent by triggering the detonator trigger 20.

The smoke shell 500 is filled with a smokescreen generating agent. The lower portion of the smoke shell 500 is inserted into a clearance between the inside upper portion of the skirt 200 and the outer side of the explosion pipe 400. The smoke shell 500 explodes together with the explosion pipe 400, thereby combusting the smoke screen generating agent for generating a smoke screen. Although the inside of the smoke shell 500 may be filled with the smokescreen generating agent alone, the inside of the smoke shell 500 may also be filled with a combination of an environmentally friendly smokescreen pigment and a color fixing agent mixed with soil. Therefore, it will generate the smokescreen to easily distinguish and scatter the soil when the smoke shell 500 has exploded.

The ogive 600 is made of an environmentally friendly degradable resin, such as poly-lactic acid (PLA), which is the same material of the explosion pipe 400. The lower portion of the ogive 600 is fixedly mounted on the upper outside of the skirt 200 to encompass the smoke shell 500 and the ogive 600 is busted when the exercise bullet collides on the target ground.

Hereinafter, an operation will be described for the forty millimeter caliber exercise bullet having the structure as describe above.

When an exercise bullet is loaded and fired through a grenade launcher, the percussion primer 110 is hit, and the propellant in the primer housing 120 is ignited. Then, the skirt 200, the safety device assembly 300, and the smoke shell 500 and the ogive 600 as a whole integral projectile is instantly launched to separate from the cartridge assembly 100 flown toward a target point. Upon firing, the exercise bullet is rotating by the spiral grooves formed on the grenade launcher. The detents 320 of the safety device assembly 300 are sliding outward by the centrifugal force. Then, the striking pin 10 will be free to move upward to leave the central mounting groove (311). When the exercise bullet collides on the target point, the striking pin 10 moves forward to impact the detonator trigger 20. Consequently, the explosive agent in the explosion pipe 400 and the smokescreen generating agent (including the color fixing agent and the smokescreen pigment) in the smoke shell 500 are ignited, simultaneously generating the smokescreen with a explosive noise.

As apparent from the above description, the forty millimeter caliber exercise bullet of the present invention allows the detents to slide outward by centrifugal force due to the rotation. It will cause the striking pin to properly hit the detonator due to impact at the target point. When the exercise bullet is fired and being rotated by the spiral grooves of the grenade launcher, it will remarkably reduce the dud rate. Further, the forty millimeter caliber exercise bullet of the present invention maintains the detent to retain the striking pin in the stationary state during the storage or transportation situation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A forty millimeter caliber exercise bullet is comprised of:

a cartridge assembly (100) forming a cylindrical shape with hollow inside for containing a percussion primer (110) and primer housing (120) at a central lower portion, a skirt (200) forming the cylindrical shape with thread on inner surface of the lower central portion, outer surface forming a rounded bottom for fixedly inserting into the cartridge assembly (100), a striking pin (10) forming a circumferential groove (11) on its outer surface of the lower portion, a safety device assembly (300) consisting of a disk-shaped detent cover (310) forming a central seat groove (311) to rest said striking pin (10), a pair of sliding grooves (312) connecting to the central seat groove (311), wherein said sliding grooves (312) are arranged 180° angle in radial direction, a detent (320) for retaining said striking pin (10) by exerting force of springs (323) to engage or disengage to the circumferential groove (11), said detent (320) integrally forming a retainer (321) at one end and a mounting rod (322) at other end for retaining the striking pin (10) by engaging or disengaging into the circumferential groove (11), said retainer (321) forming either one shape of rectangular or cylindrical, a detonator cap (330) forming a hollow pocket (331) at its central upper portion to insert a detonator trigger (20), a washer (30) sequentially inserted from the top, a press-spring (332) installed for pressing a guiding cap (340) being encompassed said striking pin (10), and the detonator cap (330) being bolted to the detent cover (310), so that the retainers (321) are sliding outwardly by a centrifugal force to disengage the circumferential groove (11) of the striking pin (10) to impact the detonator trigger (20), an explosion pipe (400) filled with an explosive agent being threaded to the lower central portion of the skirt (200) for fixedly mounting the detonator cap (330) and the detent cover (310), a smoke shell (500) filled with a smokescreen generating agent, the lower portion of the smoke shell (500) is inserted between the upper inside of the skirt (200) and the outer side of the explosion pipe (400), and an ogive (600) for surrounding the smoke shell (500), the lower portion of the ogive (600) being fixedly inserted into the upper portion of the outer skirt (200).

2. The forty millimeter caliber exercise bullet according to claim 1, wherein the detonator cap (330) forms the hollow pocket (331) for sequentially inserting the press-spring (332), the guiding cap (340) and the striker pin (10) from the bottom.

3. The forty millimeter caliber exercise bullet according to claim 2, wherein the smoke shell (500) fills the smoke screen generating agent, which is an environmentally friendly smokescreen pigment and a color fixing agent mixed with soil.

* * * * *